United States Patent [19]

Coles

[11] 4,366,793

[45] Jan. 4, 1983

[54] INTERNAL COMBUSTION ENGINE

[76] Inventor: Donald K. Coles, 2505 Capitol Ave., Fort Wayne, Ind. 46806

[21] Appl. No.: 200,369

[22] Filed: Oct. 24, 1980

[51] Int. Cl.[3] ..... F02D 5/00

[52] U.S. Cl. ..... 123/436; 123/438

[58] Field of Search ..... 123/436, 435, 419, 438; 364/431.08

[56] References Cited

U.S. PATENT DOCUMENTS

| | | | |
|---|---|---|---|
| 3,835,819 | 9/1974 | Anderson, Jr. | 123/486 |
| 3,906,910 | 9/1975 | Szlaga, Jr. | 123/440 |
| 3,972,230 | 8/1976 | Hanson et al. | 73/116 |
| 4,044,236 | 8/1977 | Bianchi et al. | 123/436 |
| 4,064,747 | 12/1977 | Rackliffe et al. | 73/116 |
| 4,138,975 | 2/1979 | Hamelin et al. | 123/436 |
| 4,140,083 | 2/1979 | Frobenius | 123/436 |
| 4,166,440 | 9/1979 | Helava et al. | 123/416 |
| 4,179,922 | 12/1979 | Bouverie et al. | 73/116 |
| 4,197,767 | 4/1980 | Leung | 123/419 |
| 4,323,042 | 4/1982 | Woodhouse et al. | 123/436 |

OTHER PUBLICATIONS

H. Eisele, SAE Publication P-57, 1974, pp. 81-88.

Gorille et al., SAE Publication SP-393, 1975, pp. 137-144.

Spilski et al., SAE Publication SP-393, 1975, pp. 145-154.

D. Hagen, SAE Publication P-76, 1978, pp. 59-63.

Meyer et al., SAE Publication SP-90, paper B-4-1, 1980, pp. 1-7.

*Primary Examiner*—Charles J. Myhre

*Assistant Examiner*—Andrew M. Dolinar

[57] ABSTRACT

A spark-ignition engine has self adaptive adjustment of the size of its fuel rations in dependence on misfires in the engine. A misfire is identified as an abnormal deficiency in energy conversion, this being detected by means of a mechanical energy discriminator which compares the quanta of energy derived from different combustion cycles. When a misfire in a particular cylinder is identified, the fuel rations to that particular cylinder are automatically increased. Overall increase of fuel rations is counteracted by gradually decreasing the fuel rations of cylinders when they are firing regularly and not producing deficient quanta of energy. In the preferred embodiment each cylinder has its own fuel injector valve. The valve is normally closed, being opened for a short interval of time during each cylinder cycle. The size of a fuel ration is regulated by varying the duration of opening of the valve. Electrical simulation of engine dynamics allows detection of misfires over a wide range of engine speeds and air intake pressures.

3 Claims, 11 Drawing Figures

INTERNAL COMBUSTION ENGINE

BACKGROUND OF THE INVENTION

1. Field of the Invention

A spark-ignition engine has individual self-adaptive adjustment of the size of its fuel rations to individual cylinders, in dependence on misfires in those cylinders.

2. Description of the Prior Art

It has been found that the specific fuel consumption of a spark-ignition engine can be reduced by burning a lean fuel-air mixture. If the mixture is too lean, however, the engine will misfire on some of its combustion cycles. Excessive misfiring will increase the specific fuel consumption and the atmospheric emission of unburned hydrocarbons. Thus it is important for both fuel economy and low atmospheric pollution that the fuel-to-air ratio be maintained within a rather narrow range.

Adaptive methods for adjusting the overall fuel-to-air ratio were described in 1975 by Gorille et al. in paper no. 750368 of the Society of Automotive Engineers, and by Spilski and Creps, paper no. 750371 of the Society of Automotive Engineers. These methods use feedback from an exhaust gas sensor to keep the overall fuel-to-air ratio close to stoichimetric.

In multicylinder gasoline engines, the circumstances of combustion are often substantially different in different cylinders. When several cylinders receive a mixture of air and fuel from the same carburetor, some of the fuel may proceed as a liquid along the walls of the intake manifold in such a way as to enter the different cylinders in different amounts. The unequal distribution of fuel wastes somes of the fuel, causes atmospheric pollution, and may cause carbon deposits, fouling of the spark plugs, excessive misfiring, preignition, and engine knock.

One method for distributing fuel and air equally to all cylinders uses a separate carburetor for each cylinder. In each carburetor, a fuel reservoir at atmospheric pressure supplies fuel to the air stream through a metering orifice, the pressure drop across the metering orifice being produced by the rush of the air stream through a Venturi tube.

Other methods for distributing fuel equally to all cylinders employ continuous or timed fuel injection, in which the pressure in a common reservoir of fuel is kept well above atmospheric pressure. A separate fuel metering orifice is used for each cylinder, the fuel entering the air stream immediately in front of the air intake valve for that cylinder. In the case of timed fuel injection, an on-off valve is associated with each metering orifice, the size of the fuel ration for each cylinder being varied by changing the length of time that its valve is open during each cylinder cycle.

All of these methods of distributing fuel to the cylinders require metering orifices whose flow characteristics are constant in time. However, during the life of the engine, the metering orifices for the different cylinders may become fouled so that their flow characteristics change, seriously affecting the engine's specific fuel consumption and atmospheric emission. It is then necessary to test and adjust or to replace the metering orifices. Maintenance of a set of metering orifices which are identical within very close tolerances can add materialially to the cost of upkeep of the engine.

Apparatus which allows individual adjustment of the fuel rations to the different cylinders has been disclosed by Anderson in U.S. Pat. No. 3,835,819. Apparatus for diagnosing faults in individual cylinders has been disclosed by Bouverie in U.S. Pat. No. 4,179,922.

SUMMARY OF THE INVENTION

A multicylinder spark-ignition internal combustion engine has individual self-adaptive adjustment of the size of its fuel rations to individual cylinders, in dependence on misfires in those cylinders. Misfires are identified by means of a mechanical energy discriminator which compares the energy derived from different combustion cycles. In the preferred embodiment, the energy discriminator comprises four testers, one for each cylinder. Each tester identifies a misfire in its cylinder by an excessive deceleration of engine speed during a power stroke of its cylinder, followed by a reduction of the declaration to a small or negative value speed. Each cylinder has a mixturastat to regulate its fuel-to-air ratio. When a misfire happens in a particular cylinder, the duration of opening of its fuel injector valve is automatically increased. Excessive overall increase in fuel rations is prevented by a counteracting decrease in the fuel rations of cylinders that are not misfiring.

In a second embodiment, each mixturastat comprises a carburetor having an adjustable metering orifice. This orifice is automatically adjusted upward or downward in flow resistance, depending on misfires in the associated cylinder.

In a third embodiment, engine dynamics are simulated electronically so that misfires can be detected and used to adjust the fuel-to-air ratio over a large range of engine speeds and intake air pressures.

General objects of my invention are to improve fuel economy and to reduce atmospheric pollution while reducing the cost of maintaining fuel metering equipment.

A specific object of my invention is to provide individual self-adaptive compensation for declining flow characteristics of the individual metering orifices in a multicylinder engine.

DESCRIPTION OF THE PREFERRED EMBODIMENT

My engine has four combustion chambers, each defined by a cylinder with a fixed closure at one end and a movable piston at the other end. The four cylinders are in a line, and their four pistons are connected to a common crankshaft. All four cranks are in the same plane, the two inside cranks being 180 degrees out of alignment with the two outside cranks. The crankshaft is connected to the load through a fluid clutch. At low engine speeds the clutch has sufficient slip that the load can remain stationary.

Each cylinder has an air inlet valve and an exhaust valve. Air reaches the inlet ports through a common air intake manifold with a single air throttle valve. Engine piston speeds are kept low to reduce pumping losses and loss of volumetric efficiency. Liquid fuel is metered by four individual metering valves, with timed fuel injection into each cylinder through its open air intake valve. The mixture of air and fuel in each cylinder is compressed by the piston, and it is ignited by means of an electric spark near the end of the compression stroke. The fuel metering apparatus is diagramed in FIG. 1.

Figure 1:
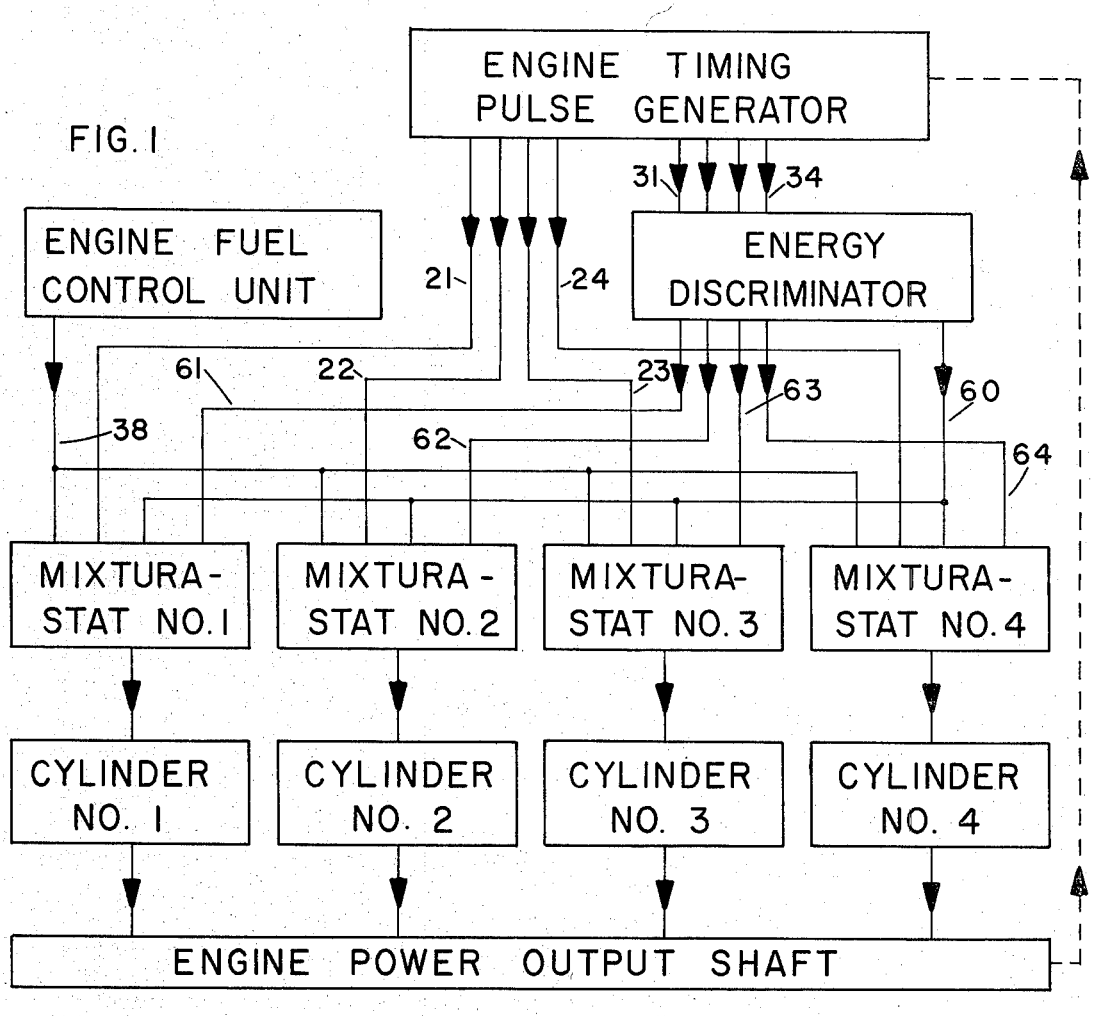
FIG. 1 is a block diagram of the basic fuel rationing system.

Referring to FIG. 1, the ENGINE TIMING PULSE GENERATOR, driven from the ENGINE POWER OUTPUT SHAFT, provides pulses for measuring engine speed and for initiating fuel injection in all cylinders. The ENGINE FUEL CONTROL UNIT contains an oscillator which transmits a high frequency signal to each of four MIXTURASTATS. This signal regulates the overall fuel-to-air ratio for the engine, but each MIXTURASTAT modifies the fuel-to-air ratio for its associated cylinder relative to the fuel-to-air ratios for the other cylinders. Energy output from the four CYLINDERS is transmitted to the ENGINE POWER OUTPUT SHAFT. The ENERGY DISCRIMINATOR receives pulses from the ENGINE TIMING PULSE GENERATOR and transmits derived signals to the four MIXTURASTATS.

Figure 2:
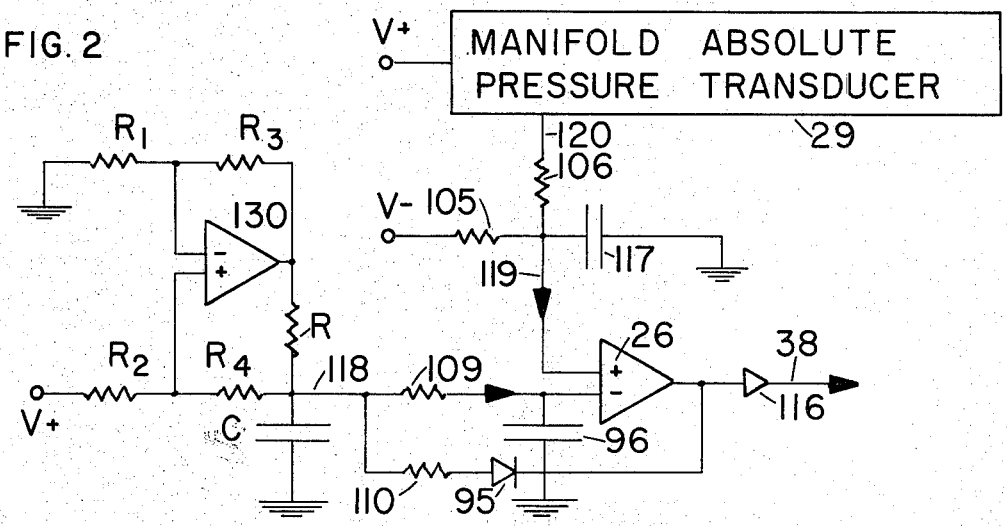
FIG. 2 diagrams the ENGINE FUEL CONTROL UNIT.
Figure 7:
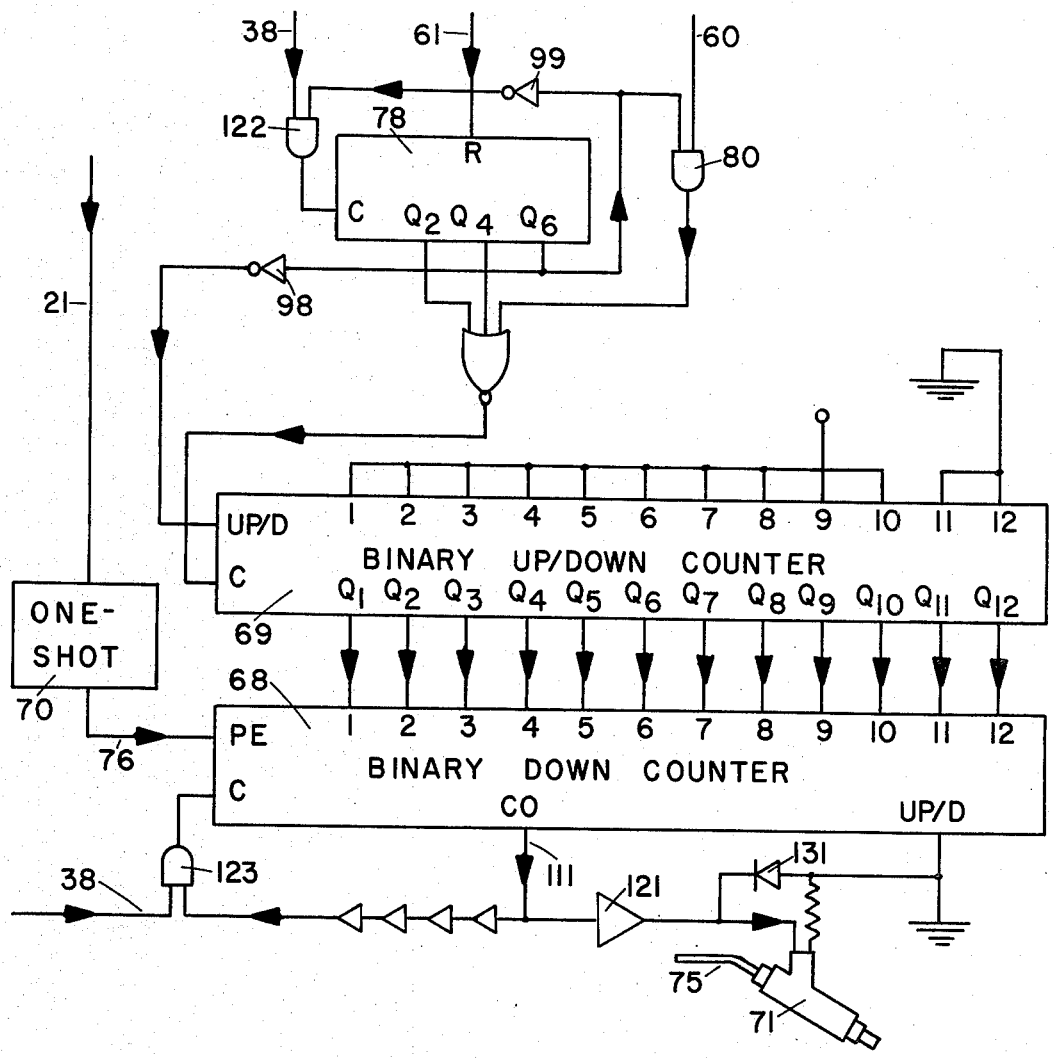
FIG. 7 diagrams MIXTURASTAT NO. 1 in the preferred embodiment.

The ENGINE FUEL CONTROL UNIT is diagramed in FIG. 2. The ENGINE TIMING PULSE GENERATOR is diagramed in FIG. 3; the ENERGY DISCRIMINATOR is diagramed in FIG. 4 MIXTURASTAT NO. 1 is shown in FIG. 7.

Figure 3:
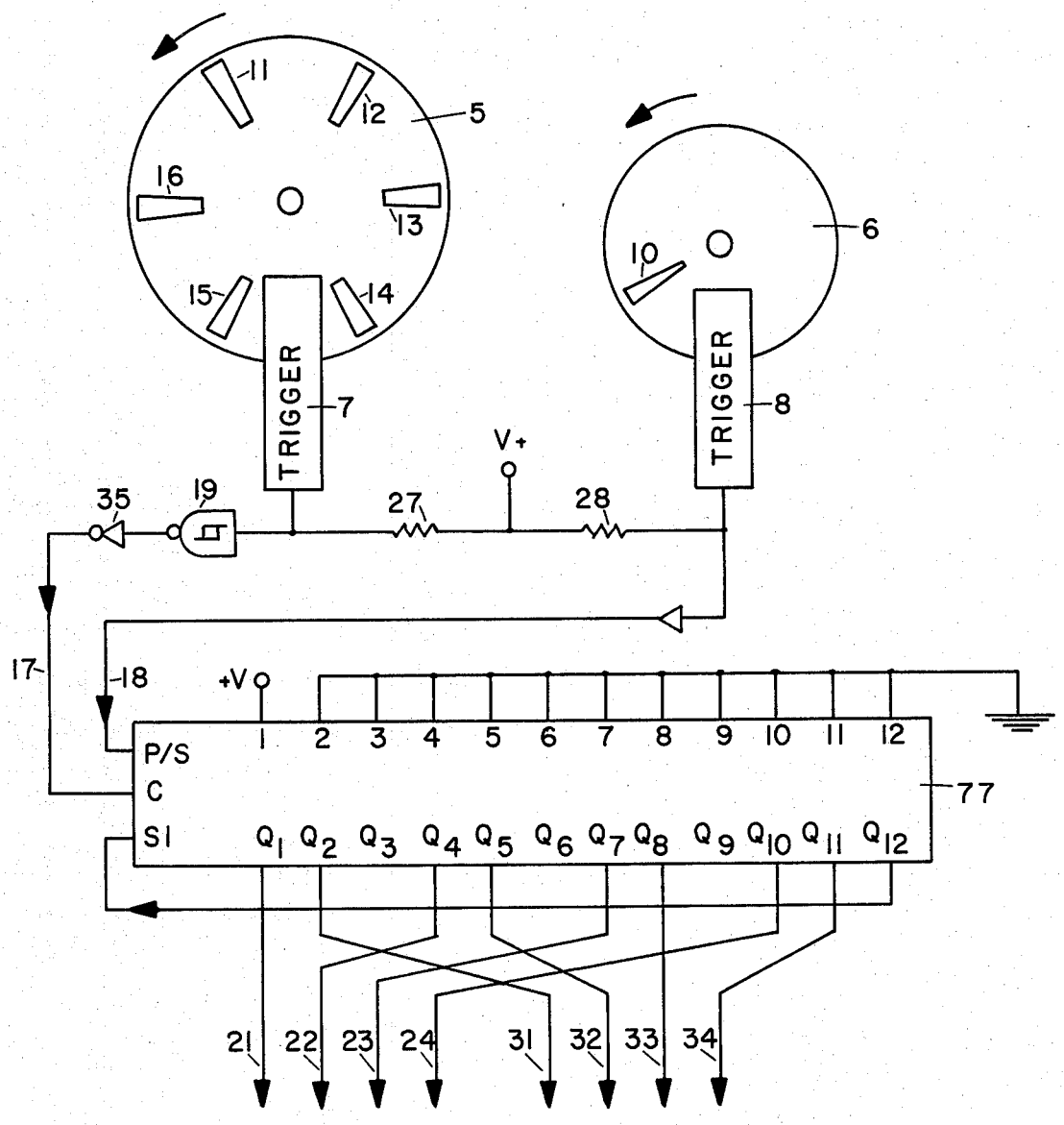
FIG. 3 diagrams the ENGINE TIMING PULSE GENERATOR.

Referring to FIG. 3, photoelectric triggers 7, 8 sense the passage of slots in slotted disks 5, 6 respectively. Disk 5 is used to time shaft speed and to initiate fuel injection. This disk is attached to the crankshaft and rotates with it. Slots 11-16 are spaced sixty degrees apart. Slot 11 passes trigger 7 near top dead center for cylinders no. 1 and 3; slot 14 passes trigger 7 near top dead center for cylinders 2 and 4. I have numbered cylinders 1,2,3,4 according to their normal firing order.

Disk 6, which rotates at one half crankshaft speed, is used to synchronize electric counters with the engine valving. Slot 10 passes trigger 8 slightly after slot 11 passes trigger 7, while the air inlet valve to cylinder no. 1 is open.

The output leads from triggers 7,8 are normally grounded within the triggers, but during the instant that a slot passes one of the triggers its output is open-circuited. This action allows the trigger output to be pulled up momentarily to the upper power supply potential (which may be 8 to 12 volts) by pullup resister 27 or 28. When one of slots 11–16 passes trigger 7, its positive output pulse is sharpened by Schmitt trigger 19 and buffer 35, then transmitted on lead 17 to the clock input of shift register 77.

Figure 5:
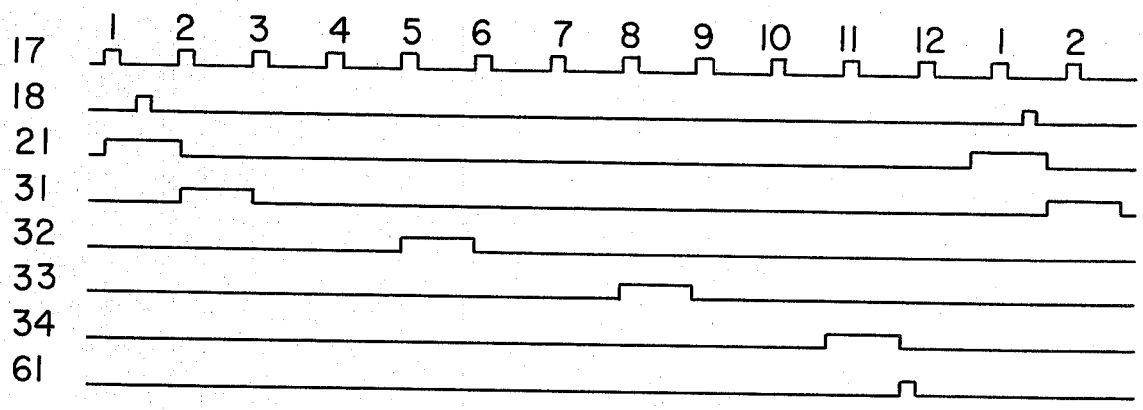
FIG. 5 indicates the timing of pulses from the engine timing pulse generator and the energy discriminator.

The output of the twelfth stage of register 77 is fed back to its serial input, so that the register becomes a divide-by-12 ring counter. The counter is synchronized with the engine valving by means of parallel data inputs, enabled by a pulse transmitted on lead 18 from trigger 8. Counter outputs are grouped in two sets with four outputs in each set; the four output pulses in each group being separated from each other by 180 degrees of crankshaft travel. Pulses on leads 21–24 are transmitted to the four mixturastats to initiate fuel injection. Pulses on leads 31–34 are transmitted to the energy discriminator for evaluating mechanical energy produced during the power strokes of the four cylinders. Timing of the output pulses on leads 17,18,21 and 31–34 is shown in FIG. 5. This timing is discussed later.

The four mixturastats are identical except for their external connections and the internal settings of their fuel rationing counters. Mixturastat no. 1 is shown in FIG. 7.

Referring to FIG. 7, down counter 68 is preset to the number in up/down counter 69. The fuel metering valve 71 for cylinder no. 1 is held open while counter 68 is counting down to zero from its preset number. When counter 68 reaches the count of zero, lead 111 goes to ground potential, inhibiting the clock input to the down counter and closing fuel valve 71. Once during each cylinder cycle, when lead 21 goes positive, one-shot 70 is triggered to produce a short positive output pulse which presets counter 68. Immediately thereafter, fuel valve 71 is opened and counter 68 starts counting down again to zero count.

The clock input to counter 68, entering on lead 38, is transmitted from the engine fuel control unit. The optimum fuel ration for each cylinder cycle is dependent on the amount of air taken into the cylinder in that cycle, which is directly dependent on the absolute pressure in the engine air intake manifold. This pressure is sensed by the engine fuel control unit, which is shown in FIG. 2.

Referring to FIG. 2, the manifold absolute pressure transducer 29 converts the air pressure into a voltage on lead 119. The transducer is a variable capacitance sensor, model P609-15A, marketed by Kavlico Corp. The output voltage V is given approximately by the equation $$V - V_1 = K \cdot P \cdot V + \qquad (1)$$

where $V_1$ is an offset voltage

P is the absolute pressure,

K is a constant of proportionality,

V+ is the upper power supply potential.

This voltage V is now converted into the period T of an oscillator.

Referring to FIG. 2, operational amplifier 130 together with resistors R and $R_1$–$R_4$ constitute a fixed current source as described in National Semiconductor Corporation Application Note 29, December 1969. page AN29-14. This source produces a small constant current through resistor R which gradually charges capacitor C to the output potential V on lead 119 from the pressure transducer. As soon as the capacitor potential exceeds V, the output of amplifier 26 goes to near ground potential. This jerks the capacitor potential back down to a voltage $V_2$ near ground potential. Now the output of amplifier 26 goes high, so that it is cut off from the capacitor by diode 95, and the capacitor slowly charges up again. Since the capacitor is being charged upward most of the time, its period T is given approximately by the equation $$T=(V-V_2)\cdot RC/V+ \quad (2)$$

The offset voltage $V_1$ of equation (1) is made equal to the offset voltage $V_2$ of equation (2) by adjustment of resistors 105 and 106 in FIG. 2, thereby making the period of the fuel control oscillator proportional to the pressure in the air intake monifold. Resistor R is set so that the maximum oscillator period, corresponding to open engine throttle at sea level, is about six microseconds.

The durations of the rationing pulses for all cylinders are proportional to the period of the fuel control oscillator, but the exact number of oscillator periods in a rationing pulse is separately adjustable for each mixturastat. These individual adjustments are made automatically, depending on information from the energy discriminator, which is diagramed in FIG. 4.

Figure 4:
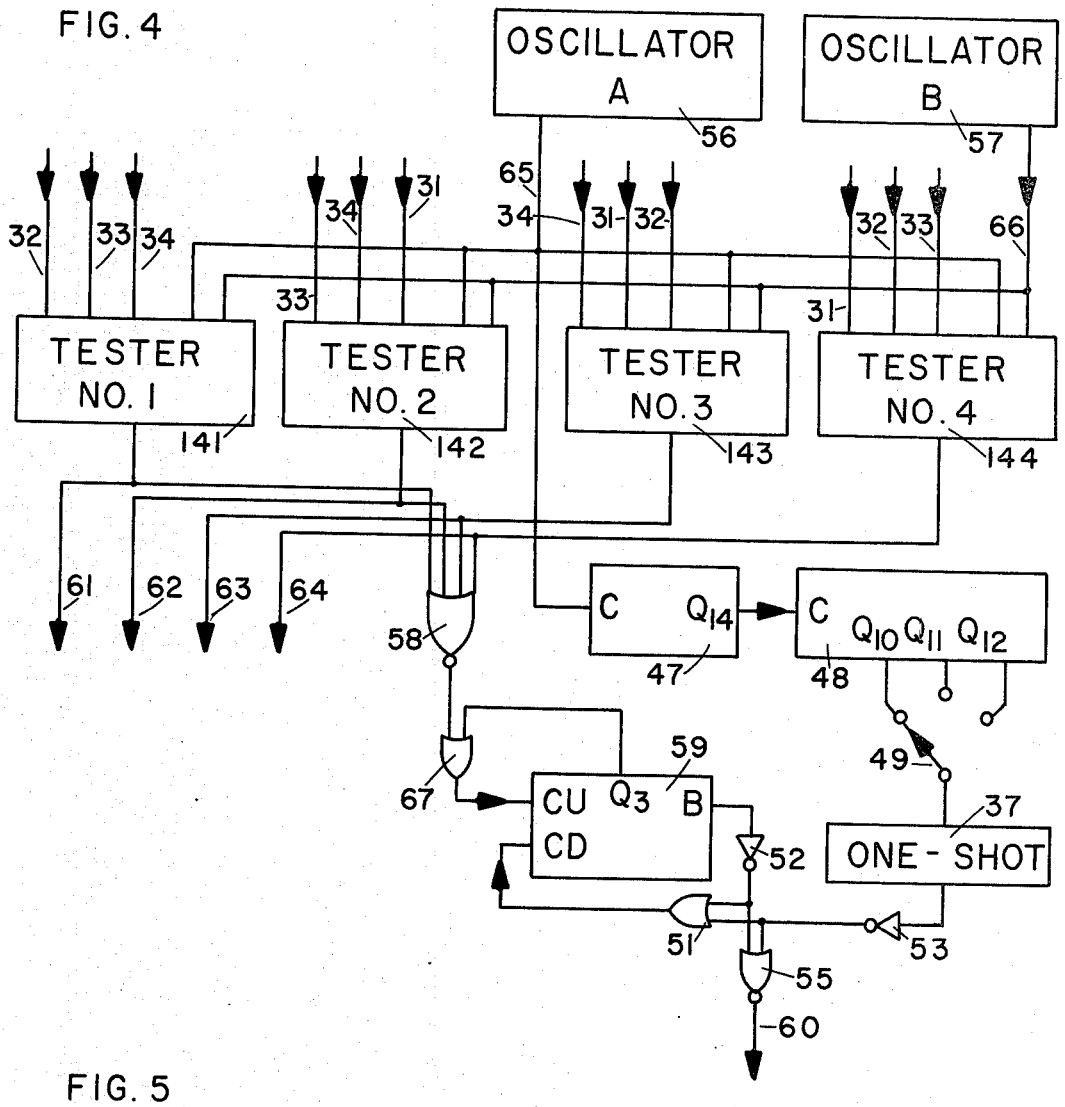
FIG. 4 diagrams the ENERGY DISCRIMINATOR.

Referring to FIG. 4, the signals on leads 31,32,33,34 are high during the crankshaft intervals from 60 to 120 degrees after the start of the power strokes of cylinders no. 3,4,1,2 respectively. A misfire is detected by timing and comparing the durations of these four intervals. Timing of the 60 degree intervals is carried out by counting the pulses from oscillators 56,57. Oscillator A has a frequency of 100 kHz; oscillator B is tuned to approximately 90 kHz. When a misfire is detected in cylinder 1,2,3 or 4, a high pulse is transmitted on lead 61,62,63 or 64 to mixturastat no. 1,2,3 or 4 respectively. These high pulses are also collected by NOR gate 58 and counter by UP/DOWN binary counter 59. The $Q_3$ output from this counter is connected back to OR gate 67 so that after the counter has counted up to 4 its clock up input is inhibited.

This energy discriminator includes four testers 141–144 which are used to test for misfires in cylinders nos. 1–4 respectively. Output leads 61–64 from the four testers are normally near ground potential, but when a misfire is detected in a particular cylinder, the corresponding output lead goes momentarily high to increase fuel rations to the particular cylinder.

In order to get counteracting downward counts, pulses from oscillator 56 are first reduced in frequency by binary counters 47,48. One of the outputs from counter 48 is selected by switch 49; its positive-going transition triggers a short positive pulse from one-shot 37 which is transmitted to all mixturastats on lead 60. These short pulses also count down on counter 59 until it reaches zero count, at which point the count-down input to counter 59 is inhibited and the transmission of pulses on output lead 60 is inhibited. This arrangement restricts the number of output pulses that can be transmitted on lead 60 without any intervening misfire signals from the misfire testers. Intervening misfire signals are collected by NOR gate 58 and counted up on counter 59. The misfire testers are identical to each other except for their external connections. Tester no. 1 is shown in FIG. 6.

Figure 6:
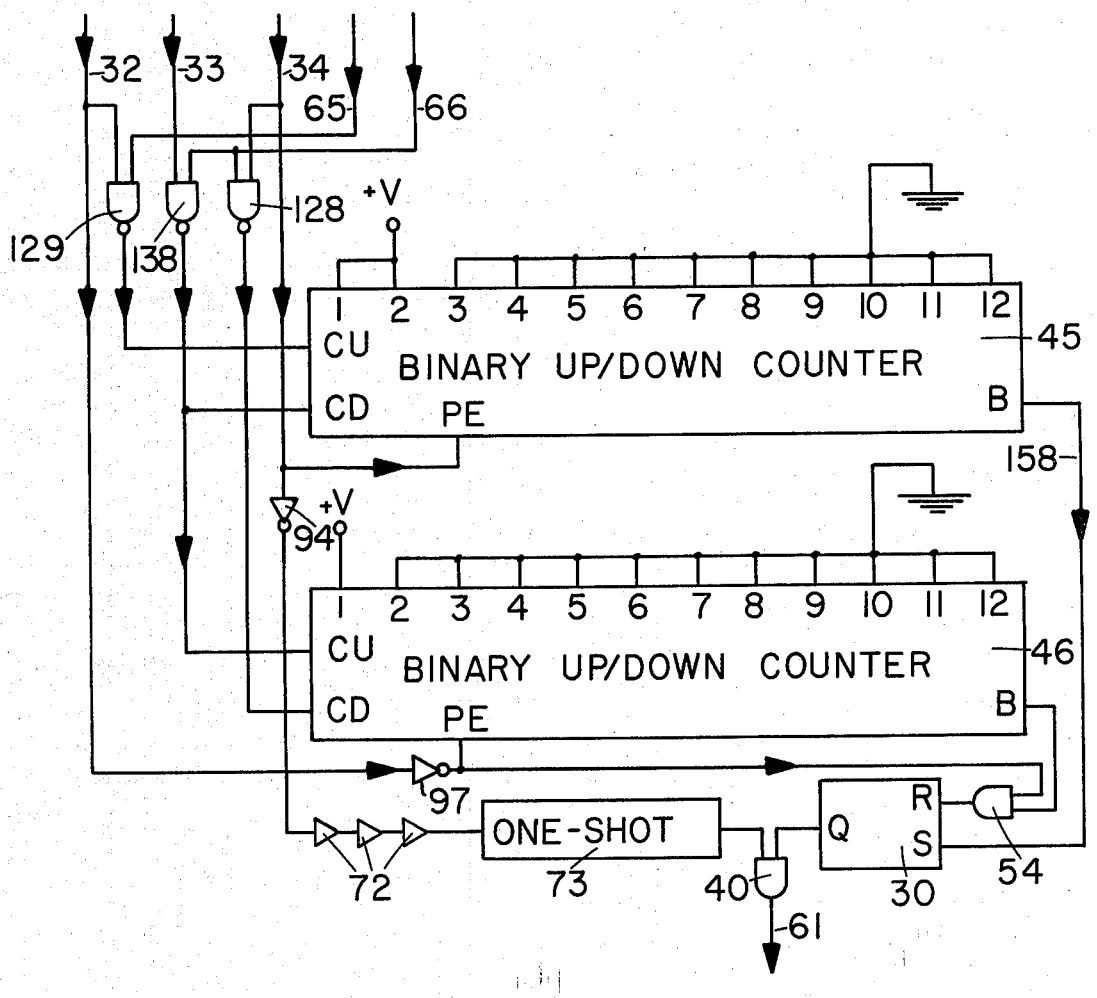
FIG. 6 diagrams TESTER NO. 1 in the preferred embodiment.

Referring to FIG. 6, pulses from oscillator A enter on lead 65; when enabled by a high pulse on lead 32 they are counted up on test counter 45, which counts both up and down. Pulses from oscillator B enter on lead 66; when they are enabled by a high pulse on lead 33 they are counted down on counter 45 and up on counter 46. When enabled by a high pulse on lead 34 they are counted down on counter 46. Timing of the pulses on leads 32,33,34 is shown in FIG. 5.

Referring to FIG. 5, the first two line of pulses, labeled 17 and 18, represent the signals transmitted on leads 17 and 18 in the engine timing pulse generator. The pulses on the third line, labeled 21, occupy the first sixty degrees of crankshaft rotation during the air induction strokes of cylinder no. 1. Pulses on the next four lines, labeled 31–34, occupy the second sixty degrees of crankshaft rotation during the air induction strokes of cylinders nos. 1–4 respectively. The pulse on the line labeled 33, for example, occurs during the induction stroke of cylinder 3, which coincides with the power stroke of cylinder no. 1. At an engine speed of 1000 RPM the duration of one of these pulses will be ten milliseconds.

Referring again to FIG. 6, if the engine speed is 1000 RPM, then during the power stroke of cylinder no. 4 the test counter 45 will count up to approximately 1000. If the engine speed remains constant during the power stroke of cylinder no. 1, the test counter will count down only to about 100, and will then be preset to a count of three during the power stroke of cylinder no. 2.

If cylinder no. 1 misfires, however, it will produce a deficient quantum of energy. In this case, the engine will slow, the downcount on counter 45 will go below zero and its borrow lead 158 will momentarily go low. This will set NAND latch 30 and enable AND gate 40. Assuming that the engine immediately starts to pick up speed again, AND gate 40 will remain enabled so that a short high pulse from one-shot 73 can be transmitted to mixturastat no. 1.

One-shot 73 is triggered during the power stroke of cylinder no. 2, by the trailing edge of the pulse entering on lead 34, after a short delay produced by buffers 72.

A deceleration which occured during the power stroke of cylinder no. 1 could also have been produced by a sudden increase in the engine load or by throttling the air intake. In this case the engine will continue to decelerate rapidly during the power stroke of cylinder no. 2. Then counter 46 will have time to count down to zero, so that latch 30 will be reset and the output pulse on lead 61 will be inhibited. Thus a test for continued deceleration is performed by counting up on test counter 46 during the power stroke of cylinder no. 1, then counting down at the same frequency during the power stroke of cylinder no. 2.

If the engine deceleration is reduced to a small value or reversed immediately after the misfire in cylinder no. 1, latch 30 will not be reset by cylinder no. 2. Then, as indicated in the bottom line of FIG. 5, the short output pulse from one-shot 73 will be transmitted on lead 61 to mixturastat no. 1, which is diagramed in FIG. 7.

Since counter 46 starts counting up from a small positive preset value, and then counts down to zero, the down count will take slightly longer than the up count. Thus even if the engine decelerates a little during the power stroke of cylinder no. 2, the timing pulse on lead 34 may terminate before counter 46 can reach zero count and send a signal out on its borrow lead to reset latch 30. In this case AND gate 40 will remain enabled so that a misfire signal, slightly delayed by buffers 72, can be transmitted on lead 61 to the mixturastat.

FIG. 6 shows a preset count of 3 on counter 45 and a preset count of 1 on counter 46. If the first four preset leads on a counter are made positive and the remainder are left at ground, then the preset value will be 15. The preset number is preferably restricted to small values such as these in order to avoid false signals due to heavy braking or throttling the engine. Thus a misfire signal will be transmitted to mixturastat no. 1 only when deceleration during the power stroke of cylinder no. 2 has been reduced to a small or negative value. (A negative deceleration being an acceleration.)

Referring again to FIG. 7, a short pulse entering on lead 61 resets counter 78, which immediately starts to count cycles of the fuel control oscillator, received on lead 38. Counter 78 is a Johnson counter with eight decoded outputs including $Q_2$, $Q_4$, and $Q_6$. Positive output pulses from $Q_2$ and $Q_4$ provide two counts upward on UP/DOWN storage counter 69 whenever cylinder no. 1 misfires. Counter 78 proceeds then until it gives a positive output from $Q_6$, at which point its clock input is inhibited at AND gate 122. When $Q_6$ of counter 78 is positive, AND gate 80 is enabled so that positive pulses from lead 60 can count downward on storage counter 69.

Storage counter 69 is a 12-stage binary counter; it counts downward one count on pulses received on lead 60 and upward two counts whenever a single pulse is received on lead 61. This storage counter is protected by a small backup battery that maintains its count when the main battery must be disconnected. The twelve binary outputs from storage counter 69 are used to preset the fuel rationing counter 68.

Whenever a high pulse is received on lead 21, its positive-going transition triggers a short output pulse from one-shot 70. This presets counter 68 to the number on counter 69. Immediately thereafter, carry-out lead 111 starts to transmit a high level signal, which is amplified by power amplifier 121 and used to turn on the fuel metering injector valve 71. At the same time the clock input on lead 38 is enabled at AND gate 123. Thus counter 68 immediately starts counting downward. When counter 68 reaches the count of zero, its carry-out lead 111 goes low—inhibiting the clock input and cutting off the fuel injection valve. The current through the valve solenoid is allowed to continue for a very short time through diode 131, in order to protect the power amplifier.

Adjustment of the fuel ration for each of the other cylinders will take place automatically in the same way as described for cylinder no. 1.

In operation at low engine speeds, the size of the fuel ration for each cylinder reaches a state of equilibrium in which the cylinder averages one misfire in every five or ten minutes, depending on the setting of switch 49 in FIG. 4.

In FIGS. 2 to 7, reference numbers represent commercial components as follows:

72 represents buffers CD405OUB,
35,52,53,94,97,98,99 represent inverter CD4049UB,
51,67 represent OR gate CD4071B,
55 represent NOR gate CD4001B,
40,54,80,122,123 represent AND gate CD4081B,
128,129,138 represent NAND gate CD4011B,
19 represents Schmitt trigger CD4093B,
30 represents NAND latch CD4044B,
77 represents shift register CD4034B,
26 represents operational amplifier CA313OB,
78 represents Johnson counter CD4022B,
45,46,59 represent UP/DOWN counters CD40193B,
47,48 represent binary counters CD406OB,
68,69 represent binary counter CD4029B,
121 represents Darlington transistor MPSU45,
7,8 represent triggers OPTO XR-CD.

The Darlington transistor is marketed by Motorola. The optical triggers are marketed by the Allison Automotive Co. The integrated circuits are marketed by RCA.

OTHER EMBODIMENTS

Automatic adjustment of fuel rations in dependence on misfires in the individual cylinders can be carried out with other types of fuel supply. The second embodient of my invention is a four cylinder engine with a separate carburetor for each cylinder. In this embodiment the fuel regulating system is as indicated in FIG. 1, except that the ENGINE FUEL CONTROL UNIT is omitted. The ENGINE TIMING PULSE GENERATOR and the ENERGY DISCRIMINATOR are the same as in the preferred embodiment. Each MIXTURASTAT in the second embodiment contains a carburetor, as shown in FIG. 8.

Figure 8:
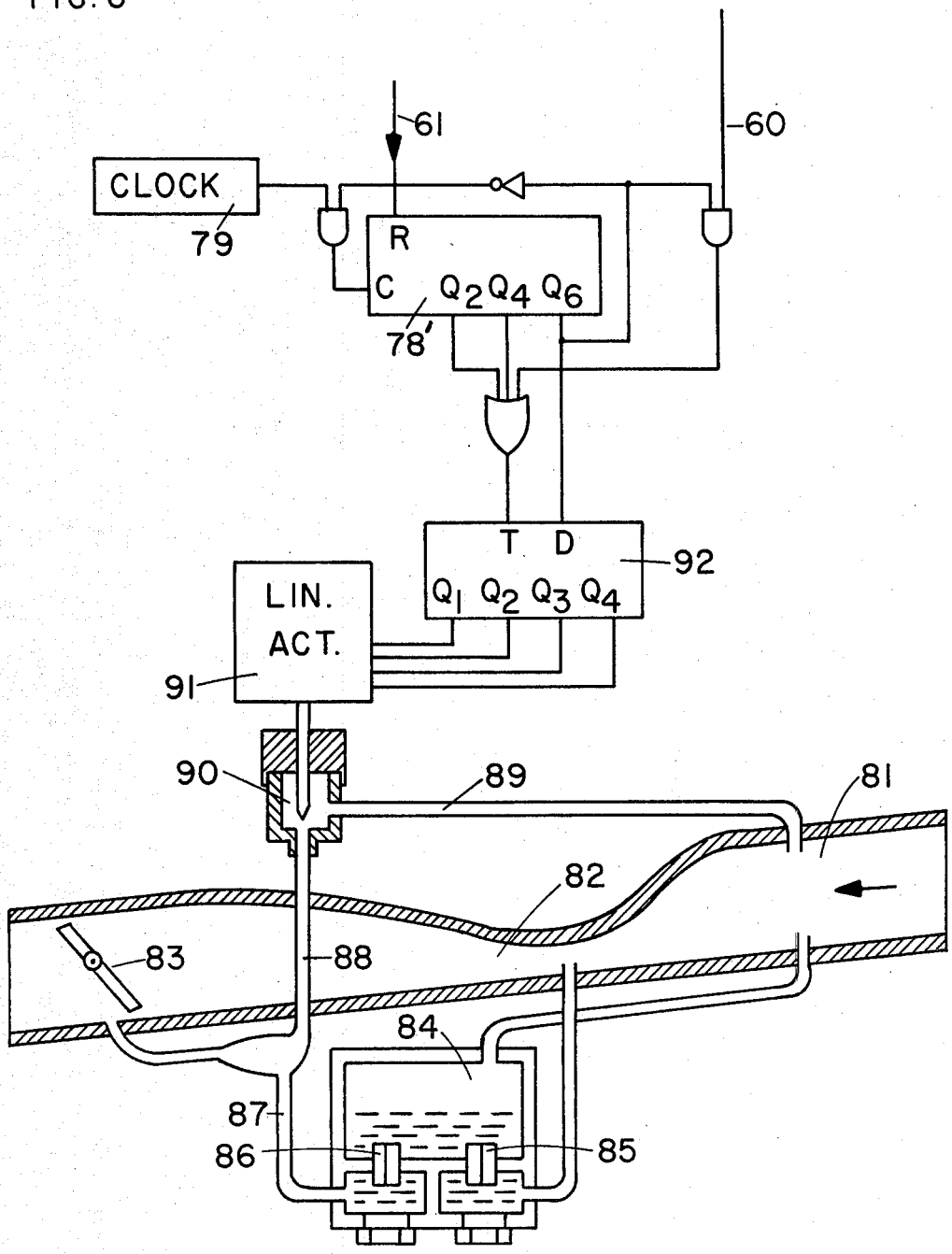
FIG. 8 diagrams MIXTURASTAT NO. 1 in a second embodiment.

Referring to FIG. 8, air for cylinder no. 1 enters at the right of induction tube 81. It passes through the Venturi section 82 and exits past throttle 83 into the cylinder. Reservoir 84 contains liquid fuel kept at a contant level. Exits from the fuel reservoir are two liquid fuel metering orifices 85,86. Orifice 85 meters liquid fuel that is sprayed into the Venturi 82 when the cylinder is sucking in air at a high rate of speed. Orifice 86 meters liquid fuel which traverses tube 87 in the low speed circuit. This fuel is mixed with air from the tube 88 and it is sprayed into the induction tube in the neighborhood of throttle 83 when the engine is throttled down and running at a slow speed.

The flow of air and the pressure in tube 88 are automatically regulated by air metering orifice 90. This orifice is varied by means of linear actuator 91, which is model no. K92121-P2, marketed by AIRPAX. The actuator is driven by integrated circuit driver 92, which is AIRPAX model SAA1027. The linear actuator controls fuel flow by regulating the pressure drop across the liquid metering orifice 86. An automatically adjusted carburetor is described by S. J. Bailey in CONTROL ENGINEERING, April 1980, page 80, but the system described by Baily uses feedback to a shared carburetor from a shared oxygen sensor in the overall engine exhaust pipe.

Referring still to FIG. 8, whenever a misfire happens in cylinder no. 1, producing a dificient quantum of energy, a short high pulse is received on lead 61 from the energy discriminator, as described in the preferred embodiment of my invention. This resets counter 78', which then transmits two pulses to driver 92 to increase the fuel-to-air ratio, as in the preferred embodiment. Similarly, a short high pulse on lead 60 from the energy discriminator changes the air metering orifice so as to decrease the fuel-to-air ratio.

As in the preferred embodiment, the size of the fuel ration in each of the cylinders tends to reach a state of equilibrium at low engine speeds, in which each cylinder misfires once in every five or ten minutes, depending on the setting of switch 49 in FIG. 4.

My method of control has advantages over the engine feedback method described by Bailey in that no special oxygen sensor is needed. Moreover, in my engine the fuel-to-air ratios are adjusted separately for each cylinder, rather than for the engine as a whole. While the apparatus described by Bailey adjusts the fuel-to-air ratio to a predetermined (stoichimetric) ratio, my apparatus adjusts the rate of cylinder misfires to a preselected rate at low engine speeds.

The energy discriminator used in the first and second embodiments does not detect misfires at high engine speeds or low air intake pressures. These limitations can be overcome by varying the deceleration threshold in dependence on engine speed and air intake pressure using a variable frequency oscillator. FIGS. 1, 2, 3, 5, 7 describing the preferred embodiment are applicable to the third embodiment of my invention.

Figure 9:
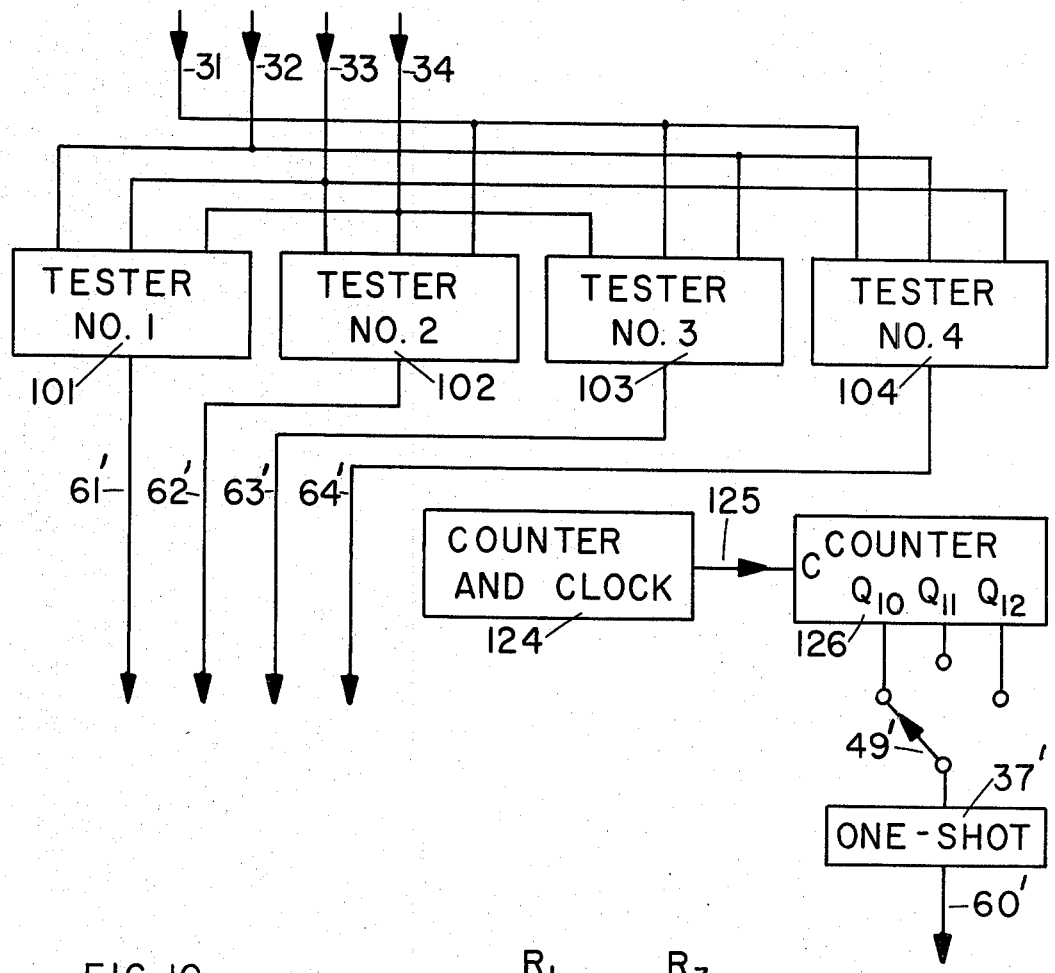
FIG. 9 diagrams the ENERGY DISCRIMINATOR in a third embodiment.

The energy discriminator for the third embodiment is diagrammed in FIG. 9, which is similar to FIG. 4 except that oscillators A,B, NOR gate 58, and counter 59 of FIG. 4 are omitted. Counter 124 of FIG. 9, which is identical to counter 47 of FIG. 4, has its own built-in clock. Testers 101–104 of FIG. 9 are identical to each other but are different from those shown in FIG. 4. Tester 101 is shown in FIG. 11.

Figure 11:
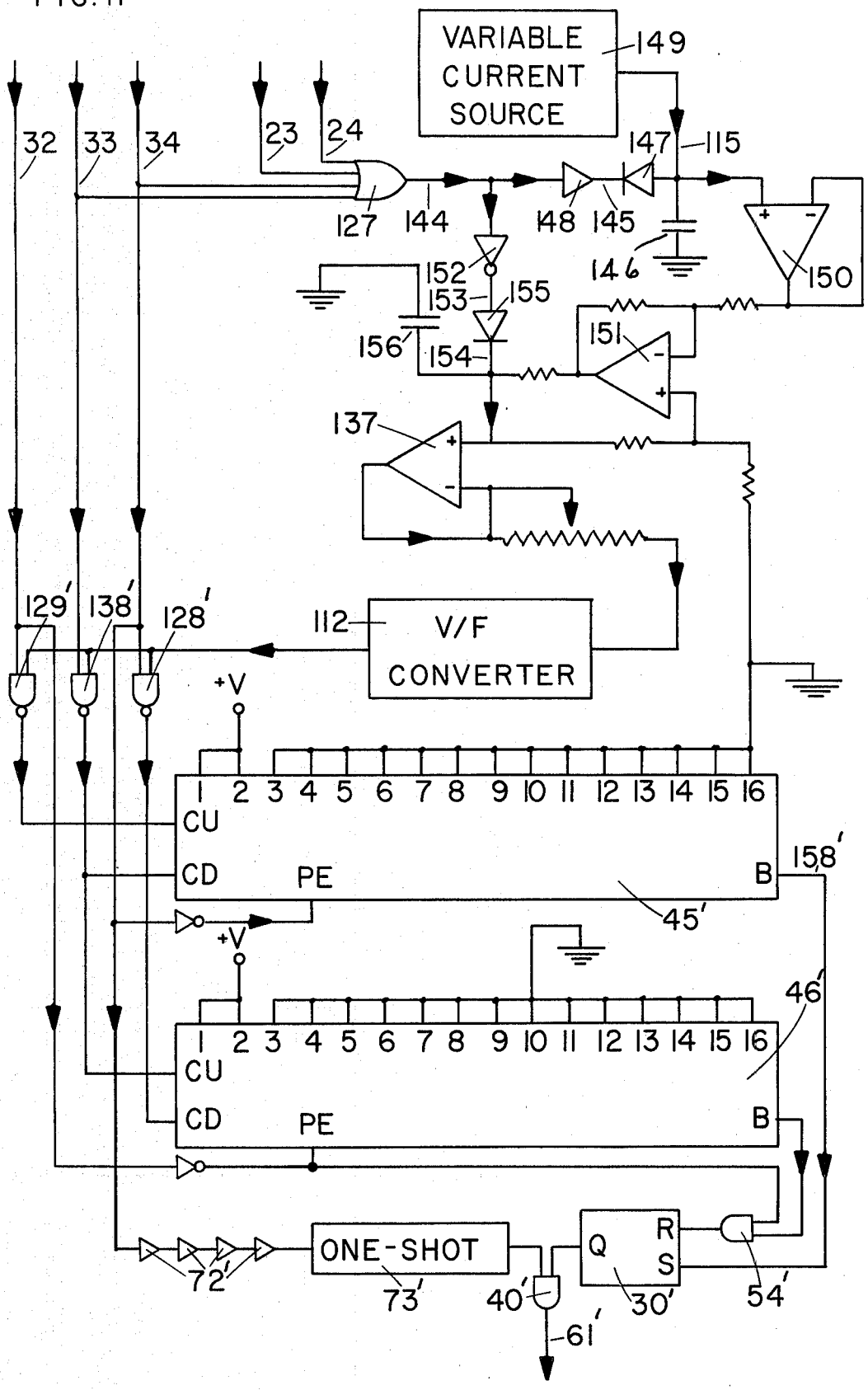
FIG. 11 diagrams TESTER NO. 1 for the third embodiment.

Referring to FIG. 11, clock 112 changes its frequency slightly in dependence on engine speed and inlet air pressure, when enabled by pulses entering on leads 23,24,33,34 from the engine timing pulse generator. When the signals on these leads are all low, the potentials on leads 144 and 145 are low. Thus capacitor 146 is clamped near ground potential. On the other hand, because of inverter 152, capacitor 156 is held near the upper power supply potential.

Figure 10:
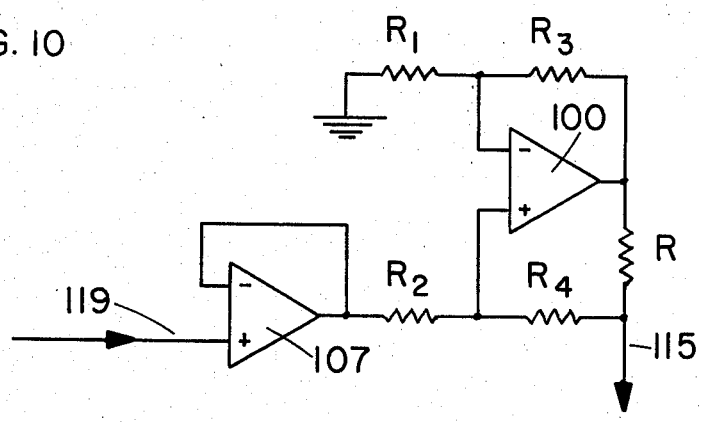
FIG. 10 diagrams a variable current source for the third embodiment.

When lead 23,24,33 or 34 is high, leads 144 and 145 are high. Lead 145 is then disconnected from capacitor 146 by diode 147, so that the small current from variable current source 149 can raise the voltage across capacitor 146 at a rate that depends on the pressure of the air in the engine air intake manifold. Details of this variable current source are shown in FIG. 10.

Referring still to FIG. 11, the rising voltage across capacitor 146 is transmitted through voltage follower 150 to variable current sink 151. These current source and sink circuits are described in National Semiconductor Corp. Application Note 29, December 1969, page AN29-14. Because of inverter 152, lead 153 is low, being isolated from lead 154 by diode 155. Thus variable current sink 151 is freed to drop the voltage across capacitor 156 by an amount which increases as the square of the time.

The diminishing voltage is converted into a diminishing frequency by voltage-to-frequency converter 112, which clocks the test counters 45' and 46', shown in FIG. 11.

The maximum frequency of clock 112 is 1.6 MHz. Each of the test counters can count up to 65,535, giving a maximum test period of 0.041 second. This corresponds to an engine speed of 244 RPM. At most engine speeds the test count will be much lower than 65,000.

In order to test for misfires in cylinder no. 1, crankshaft speed during its power stroke is compared with that of the preceding cylinder no. 4 and of the succeeding cylinder no. 2. For sixty degrees of crankshaft travel during the power stroke of cylinder no. 4, lead 32 in FIG. 11 goes high. This action enables NAND gate 129', connecting the output of oscillator 112 to the clock-up input of test counter 45'. Leads 145 and 154 hold capacitor 156 at its uppermost potential, so that clock 112 maintains its maximum frequency of 1.6 MHz. At the end of the sixty degree test interval, the clock-up count is disabled.

At the beginning of the power stroke of cylinder no. 1, lead 23 goes high and the frequency of clock 112 starts to drop. At sixty degrees into this power stroke, lead 33 goes high and the clock frequency continues to drop. When lead 33 goes high, NAND gate 138' is enabled, starting test counter 45' to count down. If cylinder no. 1 does not misfire, the test counter will not have time to count down to zero, and there will be no low signal transmitted on borrow lead 158' to set NAND latch 30'. Thus AND gate 40' will remain disabled and no misfire signal can be transmitted on lead 61'. Test counter 45' will be reset by the next high on lead 34.

Should cylinder no. 1 misfire, producing a deficient quantum of energy, the engine will slow sufficiently that counter 45' will have time to count down to zero. At that moment, its borrow output on lead 158' goes low, setting NAND latch 30' and enabling AND gate 40'. Thus when a trailing negative-going transition on lead 34 triggers one-shot 73', its output pulse can be transmitted on lead 61'.

If the engine deceleration should be due to an increased load or to throttling of the air intake, then the power stroke of cylinder no. 2 would also be slowed so that counter 46' would have time to count down to zero. Its borrow output will then go low, resetting NAND latch 30' before the positive-going transition on lead 34 can trigger one-shot 73'. The output of the one-shot will therefore be inhibited at AND gate 40' so that it will not be transmitted on 61'. Test counter 46' will be reset by the next high on lead 32.

FIG. 11 shows counter 46' preset to a count of 3. If two more preset leads are connected to the positive power supply and the remainder are left at ground potential, the counter will be preset to a count of 15. If a total of six preset leads are made positive the counter will be preset to a count of 63. The preset count is preferably restricted to small numbers such as these in order to avoid false signals due to heavy engine braking or throttling.

If the engine deceleration is due to a misfire in cylinder no. 1, the engine speed will remain nearly constant during the power stroke of cylinder no. 2, test counter 46' will not have time to count down to zero, and NAND latch 30' will not be reset. Thus one-shot 73' will transmit a positive pulse on lead 61', indicating a misfire in cylinder no. 1. As in the preferred embodiment, this positive pulse will act on mixturastat no. 1 to increase the fuel ration for cylinder no. 1. Variable current sink 149 is diagrammed in FIG. 10.

Referring to FIG. 10, lead 119 from the engine fuel control unit carries a voltage which is proportional to the pressure in the engine air intake manifold. This voltage is transmitted through voltage follower 107 to current source 100, where it produces a proportional current through resistor R and lead 115 to capacitor 146, shown in FIG. 11.

This system of capacitors charged by variable current sources simulates the dynamics of a decelerating engine, so that misfires can be detected over a large range of engine speeds and intake air pressures. The correct size of capacitors 146 and 156 in FIG. 11 increases with the moment of inertia of the crankshaft assembly, including the flywheel and the drive plate of the fluid clutch.

In the absence of a fluid clutch, the proper size for capacitors 146 and 156 increases with the inertia of the load. If there is a gear box between the engine and the load, the effective moment of inertia of the load varies as the square of the gear ratio.

If FIGS., 8 to 11, reference numbers represent commercial components as follows:

40' represents AND gate CD4081B,
128',129',138' represent NAND gate CD4011B,
127 represents OR gate CD4072B,
30' represents NAND latch CD4044B,
72' represents buffer CD405OUB,
152 represents inverter CD4049UB,
79,124,126 represent counter/clock CD406OB,
78' represents Johnson counter CD4022B,
45',46' represent UP/DOWN counters CD40193B,
37',73' represent multivibrator CD4098B,
100,151 represent operational amplifier LM108,
112 represents voltage-to-frequency converter 4707.

The operational amplifier is marketed by the National Semiconductor Corporation. The voltage-to-frequency converter is marketed by Teledyne Philbrick. The other integrated circuits are marketed by RCA.

The third embodiment of my invention is sensitive to engine misfire at all engine speeds and intake air pressures. Thus at all engine speeds each cylinder reaches a state of equilibrium in which it misfires once in every five or ten minutes, depending on the setting of switch 49' in FIG. 9.

If counter 126 in FIG. 9 is clocked by lead 34 instead of lead 125, it will count engine revolutions instead of time; the equilibrium frequency of misfires will then be proportional to engine speed. Each cylinder can then be made to average one misfire in every 5000 or 10,000 revolutions, depending on the setting of switch 49' in FIG. 9.

I claim:

1. An improved internal combustion engine having a plurality of cylinders coupled to a common power output shaft, the engine having means for metering a series of air rations and for metering a corresponding series of fuel rations, means for distributing the series of air rations with their corresponding fuel rations among the cylinders, each cylinder having means for firing each of its fuel rations with its corresponding air ration so as to produce a quantum of energy, the resulting series of energy quanta from all of the cylinders being delivered to the common power output shaft, the improvement comprising:

an individual mixturastat connected to each one of the cylinders, the mixturastat including means for automatically adjusting downward the size of the fuel rations distributed to its associated cylinder while the size of the corresponding air rations is held constant, the average rate of fractional reduction of size, when averaged over a thousand consecutive ones of its fuel rations and constant air rations, not exceeding one half per thousand consecutive ones of its fuel rations;

a mechanical energy discriminator for detecting an abnormal deficiency in the size of one of the series of energy quanta, compared to both the immediately preceding and the immediately succeeding members of the series of energy quanta, the discriminator including means for associating the abnormally deficient quantum of energy with the particular cylinder which produced it and for sending a misfire signal to that mixturastat which is connected to the particular cylinder;

means within each mixturastat for automatically adjusting upward the size of fuel rations distributed to its associated cylinder when the energy discriminator sends it a misfire signal, the single fractional increase in size of the fuel ration not exceeding one fifth when the size of the air ration is unchanged.

2. An internal combustion engine as recited in claim 1 wherein the mechanical energy discriminator comprises:

electronic means for measuring the substantially instantaneous speed of rotation of the power output shaft, electronic means for determining when a momentary deceleration of the shaft speed exceeds a threshold value, and when the excessive deceleration is immediately followed by a reduction of the excessive deceleration to a small or negative value.

3. An internal combustion engine as recited in claim 1 wherein the mixturastat associated with each of the cylinders is a timed fuel injection apparatus comprising:

an electrically actuated fuel metering value for timing the delivery of fuel to its associated cylinder;

a metering pulser for opening the fuel metering valve, the duration of opening of the valve for each fuel ration being automatically adjustable in partial dependence on misfires in its associated cylinder.

* * * * *